US005907267A

United States Patent [19]

Reid et al.

[11] Patent Number: 5,907,267

[45] Date of Patent: May 25, 1999

[54] PHOTOELECTRIC AUXILIARY SWITCH FOR ELECTROMAGNETIC CONTACTOR

[75] Inventors: Scott A. Reid, Brookfield; Francis S. Richards, Jr., Germantown, both of Wis.

[73] Assignee: Eaton Corporation, Cleveland, Ohio

[21] Appl. No.: 08/851,859

[22] Filed: May 6, 1997

[51] Int. Cl.[6] ..... H01H 73/12

[52] U.S. Cl. ..... 335/17; 335/1; 335/6; 335/132; 340/638

[58] Field of Search ..... 335/1, 6, 131, 335/132, 151, 17; 307/116, 119, 125, 139; 340/638, 639, 644

[56] References Cited

U.S. PATENT DOCUMENTS

| | | | |
|---|---|---|---|
| 3,436,497 | 4/1969 | Mading | 200/16 |
| 4,032,735 | 6/1977 | Butterworth | 200/68 |
| 4,309,683 | 1/1982 | Grunert et al. | 335/132 |
| 4,760,364 | 7/1988 | Ostby | 335/132 |
| 5,198,789 | 3/1993 | Taylor | 335/132 |
| 5,424,900 | 6/1995 | Kiiskinen et al. | 361/116 |

*Primary Examiner*—Renee S. Luebke
*Assistant Examiner*—Raymond Barrera
*Attorney, Agent, or Firm*—Larry G. Vande Zande

[57] ABSTRACT

Photoelectric reflective object sensors are mounted in an exteriorly mounted auxiliary switch case to detect a member on a movable contact assembly of the contactor to produce logic level output signals indicative of the operational state of the contactor electromagnet. One or a pair of photoelectric sensors are used in a side mounted auxiliary switch to detect the contactor movable contact assembly in the energized or de-energized position, or en route between the two positions. A single photoelectric sensor is used in a top adder auxiliary switch to detect if the movable contact assembly is or is not in the extended (de-energized) position. The auxiliary switches provided logic level output signals directly usable with microprocessor based controllers.

20 Claims, 4 Drawing Sheets

PHOTOELECTRIC AUXILIARY SWITCH FOR ELECTROMAGNETIC CONTACTOR

BACKGROUND OF THE INVENTION

This invention relates to electromagnetic contactors and to auxiliary switches used therewith. More particularly this invention relates to improved exteriorly mounted auxiliary switches which do not have physical connection to the operating structure of the contactor. Still more particularly this invention relates to top adder and side mounted auxiliary switches of the aforedescribed type which produce logic level electrical output signals.

Electromagnetic contactors are utilized to switch three phase electric power to a load device such as an electric motor or the like. The contactor comprises three pairs of contacts, one for each phase, within a housing. The contactor housing is provided with means for attachment of an additional contact block, usually on the top or front face of the housing. The additional contact block has its own movable contact assembly which is connectable to the movable contact assembly and electromagnet armature of the contactor to operate the additional set of contacts in conjunction with operation of the primary contacts. The sides of the electromagnetic contactor housing have window openings and provisions for mounting auxiliary switch units to the sides of the contactor housing. The auxiliary switch units are customarily mechanically operated units each having a linearly slidable plunger which has operative physical connection with the movable contact assembly and electromagnet armature of the contactor through the respective window opening. Each of the side mounted auxiliary switch units and the top mounted add on contact block have individual contact members, each of which have springs for providing contact pressure in the contact closed positions. Each of these springs introduces a cumulative force which must be overcome by the electromagnet prior to sealing of the armature to the core, thereby requiring that the electromagnet be designed to provide sufficient force for effecting closing of the maximum number of auxiliary contacts. Moreover, the use of mechanically operated contact mechanisms introduces additional friction and component wear to the device as well as affecting contact electrical and mechanical wear and erosion.

In present day intelligent and diagnostic electrical control systems, it is desirable to provide current information to the system controller as to the status of the various control elements, such as an electromagnetic contactor. It is desirable that the system controller know whether the contactor is operated to a closed condition whereby the armature is sealed to the electromagnet core or if the contactor is in the open position wherein the armature is biased away from the electromagnet core. This could be detected with an electromechanical auxiliary switch wherein one set of contacts are closed when the contactor armature is sealed to the core and another set of contacts are closed when the electromagnetic contactor armature is biased away from the core. However, as aforedescribed, the additional spring and frictional forces as well as the component wear of the electromechanical devices are not desirable. Moreover, the controller is commonly microprocessor based such as a personal computer, programmable controller or the like, and the signals to be provided to the microprocessor should preferably be at the logic level magnitude, not readily attainable in electromechanical devices.

SUMMARY OF THE INVENTION

This invention provides photoelectric auxiliary switches for an electromagnetic contactor comprising photoelectric transmitter/receiver devices mounted inside of an auxiliary switch case which is readily mounted to a top or side wall of the contactor overlying a window in which a target on the movable contact and armature assembly of the contactor appears. A single photoelectric device may be utilized in the auxiliary switch case to determine if the armature and movable contact assembly is in the open position, for the side mounted auxiliary switch, or in the closed (sealed) position, or two photoelectric devices may be utilized in the side mounted version to positively monitor the position of the armature and movable contact assembly in each of the open or, for the side mounted auxiliary switch, the closed position. Alternatively, a single photoelectric sensor may be positioned intermediate the open or closed position to detect movement of the armature from one position to the other. The invention employs an infrared photoelectric sensor which penetrates the auxiliary switch case, but also contemplates an alternative visible range photoelectric device wherein the switch case is made of transparent dielectric material. The ability of the photoelectric light beam signal to penetrate the case material of the auxiliary switch permits the switch case and the contactor window to be sealed from environmental contaminants.

The invention, its features and advantages, will become more readily apparent when reading the following description and claims in conjunction with the accompanying drawings.

DETAILED DESCRIPTION OF THE PREFERRED EMBODIMENT

Figure 1:
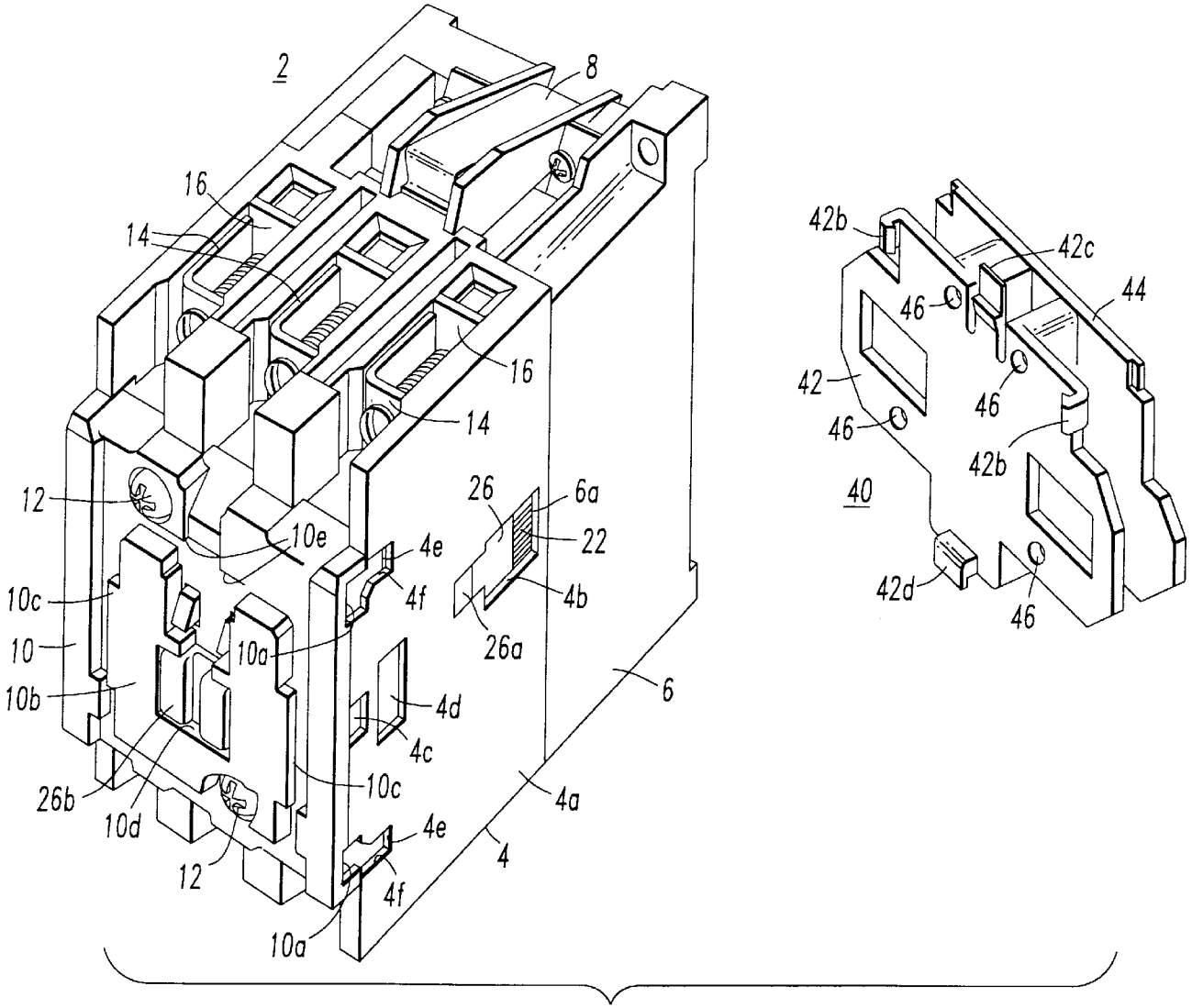
FIG. 1 is an exploded axonometric view of electromagnetic contactor and an auxiliary switch constructed in accordance with this invention.
Figure 2:
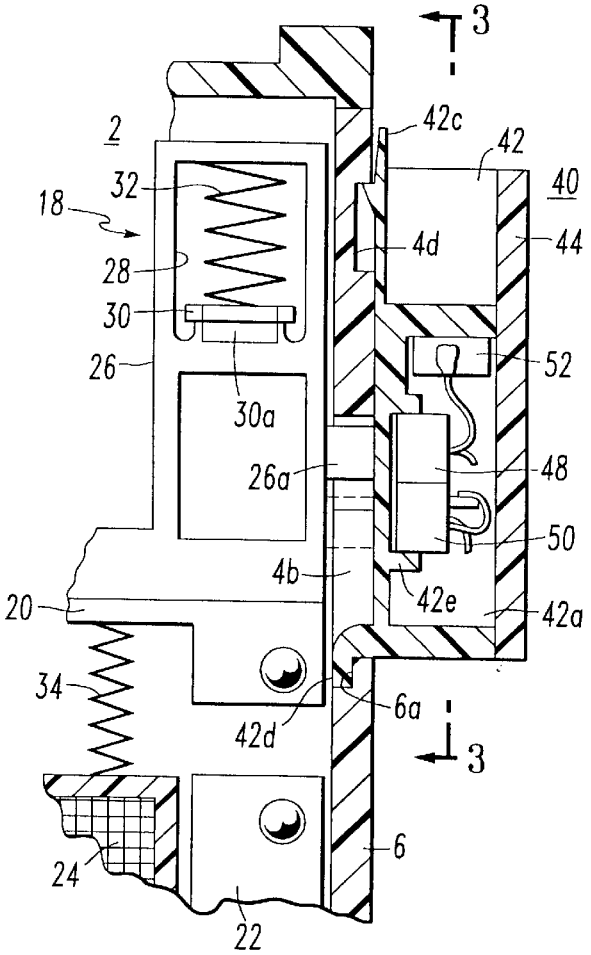
FIG. 2 is a fragmentary cross sectional view taken through the contactor and auxiliary switch.

An electromagnetic contactor 2 is shown in FIG. 1. The contactor 2 is of known construction having a molded dielectric enclosure comprising an open top upper housing 4 and an open top lower housing 6, the upper housing being attached over the open top of the lower housing and secured in place by a clip 8 which is hinged to the lower housing 6 and snaps over a projecting foot on upper housing 4. A dielectric cover 10 is attached over the open top of upper housing 4 by a pair of screws 12. Upper housing unit 4 is divided into three poles by appropriate barriers. Each pole has a pressure type clamping terminal assembly 14 attached to a projecting portion of a stationary contact 16 at opposite ends of the pole, only one end of each pole being visible in FIG. 1. Internally, a movable contact assembly 18 is attached to a movable armature 20 of an electromagnet which further comprises a fixed core 22 and coil 24 (see FIG. 2). The movable contact assembly 18 comprises a molded insulating movable contact carrier 26 having a contact opening 28 in each pole in which a movable contact member 30 is positioned, biased against a lower edge of the opening by a helical compression spring 32. The opposite ends of each movable contact 30 has precious metal contact tips 30*a* attached thereto (only one visible in FIG. 2) to align with and bridge the respective contact tips of the stationary contact members 16 (FIG. 1). A helical compression spring 34, shown schematically in FIG. 2, biases the movable contact assembly 18 away from coil 24 and stationary electromagnet core 22 in a de-energized condition of the electromagnet, separating the movable contact 30 from the stationary contacts 16.

A side wall of the insulating housing of electromagnetic contactor 2 is provided with various openings and recesses to be described for the purpose of attaching a side mounted auxiliary switch 40 in a known manner. A window 4*b* is open to the bottom edge of upper housing unit 4. A pair of rectangular recesses 4*c* and 4*d* are provided in side wall 4*a* at and near the upper edge of the upper housing unit. Recess 4*c* is shallower and smaller in area than recess 4*d*. The upper edge of the recess 4*d* is square, i.e. at right angles with the wall 4*a*, to present a good latching surface as will be discussed in more detail hereinafter. A pair of slots 4*e* are provided in the upper edge of wall 4*a*, the slots being provided with reduced thickness inner lateral edges 4*f* to provide vertical slides for corresponding hooks 42*b* of side auxiliary switch 40. The side of cover 10 is relieved at areas 10*a* which are in alignment with slots 4*e* to permit insertion of the hooks 42*b* into the area above lateral edges 4*f* to permit the auxiliary switch 40 to be placed flat against side wall 4*a* and subsequently slid into position whereupon the hooks 42*b* engage edges 4*f*. The side wall of lower housing unit 6 has a reduced thickness slot 6*a* in the area of window 4*b* for receiving the tang of hook 42*d* of auxiliary switch 40. Engagement of hook 42*d* in slot 6*a* anchors the lower end of auxiliary switch 40 firmly against side wall 4*a* of the contactor. As auxiliary switch 40 is slid into position along side wall 4*a*, a resilient catch 42*c* of auxiliary switch 40 is deflected by the side wall 4*a* until it aligns with the upper edge of recess 4*d*, whereupon it snaps into the recess 4*d* to secure the auxiliary switch 40 against reverse movement along the wall 4*a*, thereby latching the auxiliary switch 40 to the contactor 2.

Figure 3:
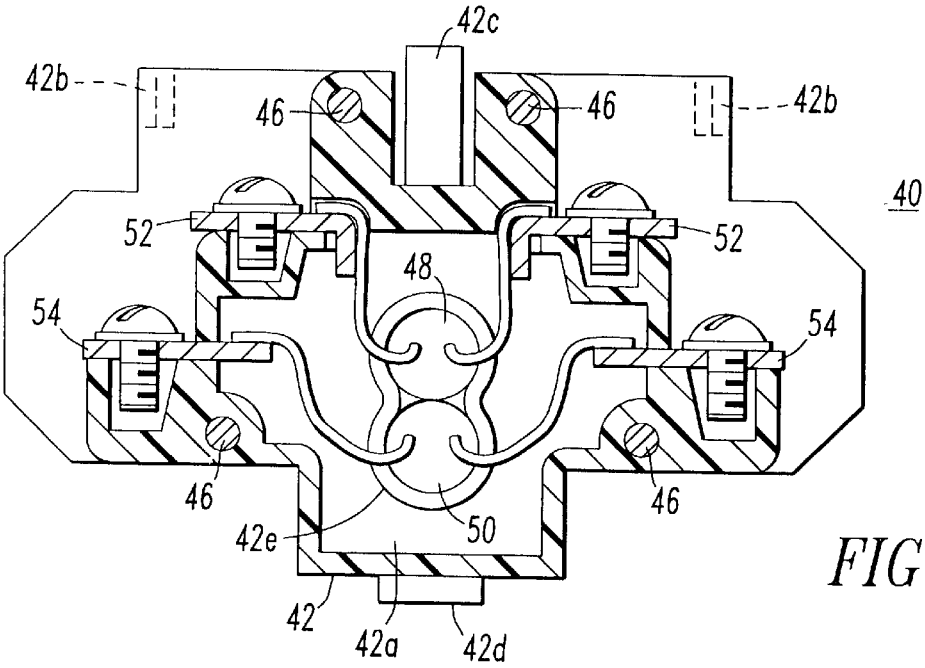
FIG. 3 is a cross sectional view taken through the auxiliary switch generally along line 3—3 in FIG. 2.
Figure 5:
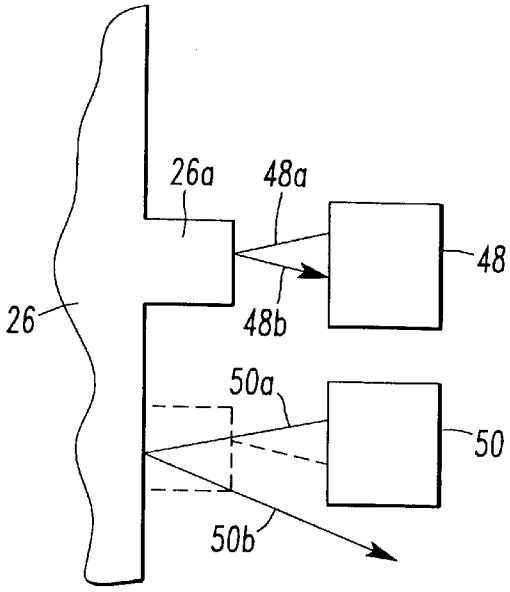
FIG. 5 is a schematic view of the contactor armature and movable contact assembly target and two photoelectric sensor devices of the auxiliary switch.

Auxiliary switch 40 comprises a molded dielectric case 42 having a hollow internal chamber 42*a* (FIGS. 2 and 3) which is closed off by a cover 44 secured over the open side of the case by four rivets 46 (FIG. 1). Internally, chamber 42*a* is provided with means such as a pair of cylindrical pockets 42*e* for mounting a pair of photoelectric reflective object sensors 48 and 50. The interior wall surface of chamber 42*a* is recessed in the area of pockets 42*e* adjacent window opening 4*b* of the contactor to present a thinner wall for auxiliary switch 40 adjacent the window opening to facilitate better coupling of the photoelectric signals. The photoelectric sensors 48 and 50 may be infrared devices such as are manufactured and sold by Optek Technology, Inc. of Carrolton, Tex. The dielectric case 42 of switch 40 is made of an infrared transmissive material such as pholyphenylene sulfide or the like which will permit an infrared light beam emitted by the sensors 48 and 50 to pass through the wall of case 42. Movable contact carrier 26 of contactor 2 has a projection 26*a* disposed within the window 4*b*. When the electromagnet is de-energized and the contactor 2 is in the open position, the projection 26*a* is in an at rest position located adjacent the top edge of the window 4*b*. When the electromagnet is energized and the armature and movable contact assembly 18 is attracted to the stationary core 22, the projection 26*a* occupies a second position within window 4*b* as represented by dotted lines in FIGS. 2 and 5. The photoelectric sensor 48 is positioned adjacent the uppermost position of the projection 26*a* and the photoelectric sensor 50 is positioned adjacent the lowermost position of projection 26*a*. Each of the photoelectric sensors 48 and 50 emit an infrared light beam 48*a* and 50*a*, respectively as seen in FIG. 5. If the projection 26*a* is positioned immediately opposite the sensor, the light beam is reflected off the face of projection 26*a* back to the receiver portion of the photoelectric sensor 48 such as at 48*b* in FIG. 5 to cause the sensor to change its output state. If projection 26*a* is not aligned with the sensor such as 50 in FIG. 5, the light beam 50*a* travels to the side surface of the movable contact carrier 26 before being reflected. The reflected light 50*a* beam then misses the receiver portion of the photoelectric sensor 50 entirely and the output signal of sensor 50 is not changed. When the electromagnet of the contactor is energized, the movable contact assembly 18 moves to its alternate position and projection 26*a* now reflects the beam of photoelectric sensor 50 to cause it to change output states whereas the light beam of photoelectric sensor 48 is reflected from the surface of the movable contact carrier 26 such that it misses the receiver of photoelectric sensor 48. The case 42 of switch 40 is provided with appropriate slots for receiving conductive terminals 52 and 54 into which screws may be threaded for connection to external circuits. The wires from photoelectric sensors 48 and 50 are connected to terminals 52 and 54 within chamber 42*a* by soldering or the like.

Figure 6:
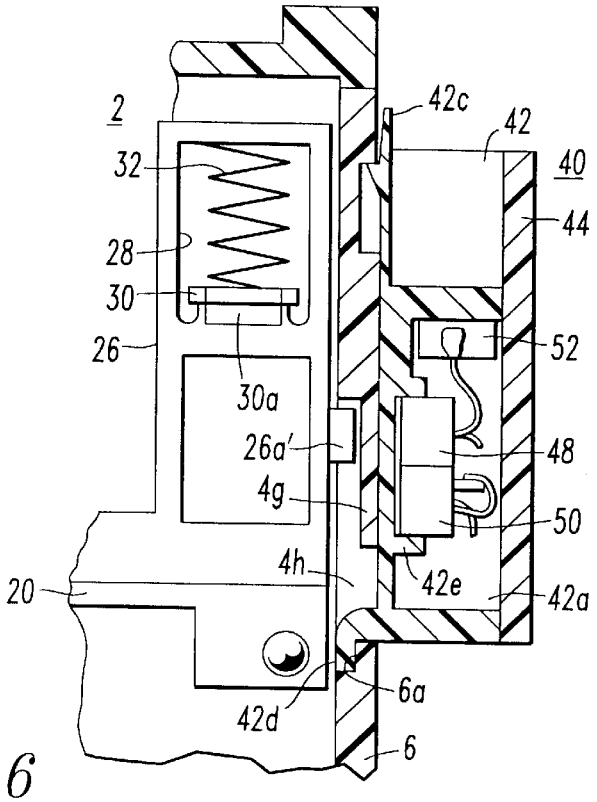
FIG. 6 is a fragmentary cross sectional view similar to FIG. 2 but showing another alternate embodiment wherein the window in the contactor housing is substantially closed.
Figure 4:
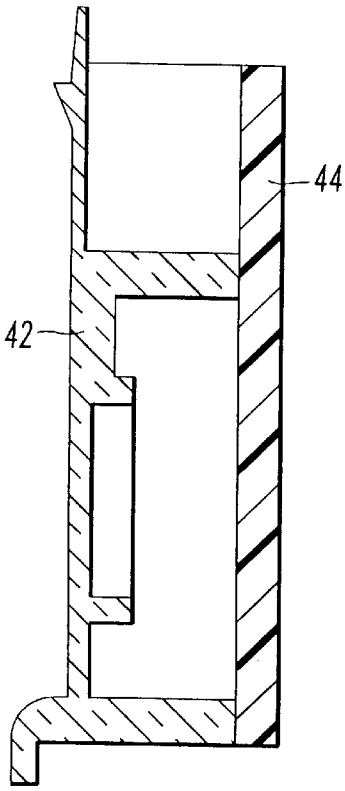
FIG. 4 is a cross sectional view of the auxiliary switch similar to that shown in FIG. 2, but showing an alternate embodiment of the auxiliary switch case.

It can be seen from the foregoing that the particular manner in which the auxiliary switch 40 and its photoelectric sensors 48 and 50 respond is highly selective. The sensors may be biased on or off when no reflected light signal is present. A single sensor may be used to sense both positions of the movable contact assembly, and the single sensor may be located in either the upper or lower position illustrated. Further, the switch may be modified to place a single sensor midway between the upper or lower position to be operated as the electromagnet operates from one condition to another. The photoelectric sensors produce logic level output signals which may be directly handled by microprocessor based controllers. The auxiliary switch 40 may be effectively sealed against the environment, thereby eliminating maintenance and faulty signal problems. The contactor housing per se may be sealed by providing a cover 4*g* over a major portion of window 4*b* as shown in FIG. 6. Only a small opening 4*h* is required for insertion of tang 42*d*, and it should be readily recognized that alternative structures could be employed if total sealing were required. The cover 4*g* can be a separate piece made of an infrared transmissive material as is the case 42, or the upper unit 4 may be made entirely of IR transmissive material. Still another alternative embodiment contemplated herein is to use visible wavelength emitter/receiver photoelectric devices, whereupon the case 42 would be formed of a transparent dielectric material as shown in FIG. 4.

Figure 7:
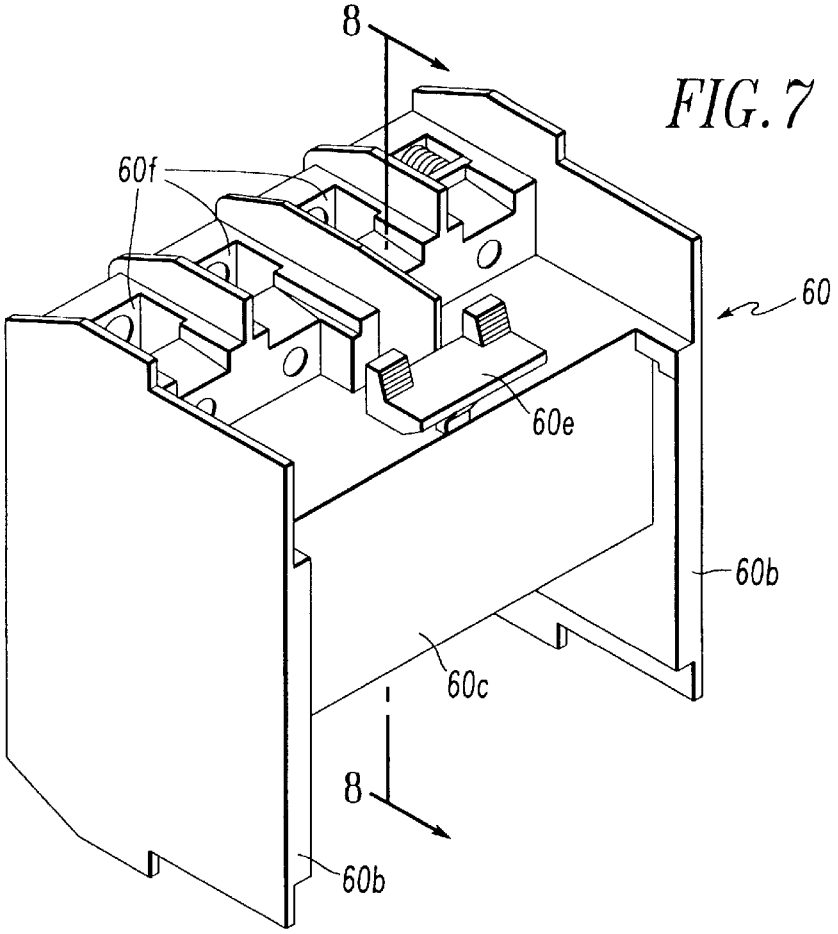
FIG. 7 is an axonometric view of a top adder auxiliary switch housing constructed in accordance with this invention.
Figure 8:
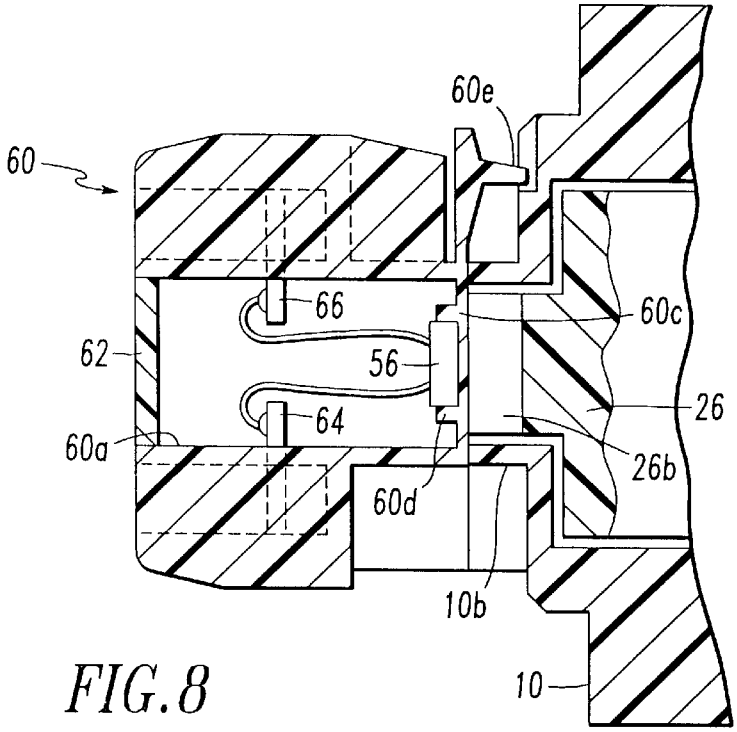
FIG. 8 is a cross sectional view taken through the top adder unit of FIG. 7 along line 8—8 and through a portion of the contactor.

Another embodiment is shown in FIGS. 7 and 8 wherein a single photoelectric sensor 56 is placed in a closed cavity 60*a* of a modified top adder housing 60. Referring also to FIG. 1, the top of cover 10 has a raised rectangular boss 10*b*.

The sides of boss 10*b* have angularly undercut wings 10*c* to form slides for complementary shaped wedges along the bottom edges 60*b* of housing 60. A central opening 10*d* in boss 10*b* forms a window opening for a dovetail-grooved projection 26*b* of movable contact carrier 26 which ordinarily forms a coupling for the movable contact carrier of an electromechanical top adder. The projection 26*b* is disposed flush with the top surface of cover 10 in the de-energized condition of the electromagnet, and serves as a target for photoelectric sensor 56.

The modified top adder housing is closed by a bottom wall 60*c* and a cover 62 over the open upper end of cavity 60*a*. An appropriately shaped rim 60*d* is provided on the interior surface of bottom wall 60*c* to position and retain sensor 56. The housing 60 is attached to the top face of contactor 2 by aligning the sides of housing 60 with the undercut wings 10*c* of cover 10 and sliding the housing into place over the boss 10*b*. A latch 60*e* is provided in housing 60 to engage surfaces 10*e* of the cover. Housing 60 has four pairs of openings in top and bottom walls for aligned terminals of an electromechanical version. As a photoelectric sensor, only a pair of the openings are used to receive terminals 64 and 66. Wire leads from sensor 56 are soldered to the terminals within cavity 60*a*. Screws (not shown) are threaded into terminals 62 and 64 outside the cavity 60*a* for attachment of wire leads.

The top adder style of photoelectric switch 56 operates when the contact carrier 26 is in its fully extended position, i.e. when the electromagnet is de-energized and the movable contact assembly 18 has freely returned to the extended position. Energization of the electromagnet and retraction of the movable contact assembly from the forward end of the housing causes the projection 26*b* to move into the housing, deactivating sensor 56.

It will be apparent from the foregoing that the exteriorly mounted photoelectric auxiliary switch for an electromagnetic contactor described herein is susceptible of various modifications and changes without departing from the scope of the appended claims.

We claim:

1. An auxiliary switch for an electromagnetic contactor wherein said contactor comprises:

an electromagnet comprising a fixed magnetic core, an electric coil disposed around said core, and a movable magnetic armature;

stationary contacts;

a dielectric movable contact carrier connected to said armature;

movable contacts associated with respective said stationary contacts, said movable contacts being carried by said contact carrier; and spring means for biasing said armature and said contact carrier to a first position wherein said armature is spaced from said core and said movable contacts are out of engagement with said stationary contacts, said electromagnet coil being energizable for effecting attraction of said armature to a second position wherein said armature is seated against said core and said movable contacts are in engagement with respective said associated stationary contacts;

said auxiliary switch being attached to said contactor and comprising:

reflective photoelectric sensor means directed at said contact carrier, said reflective photoelectric sensor means comprising a signal source for emitting a signal and receiver means for receiving a reflected said signal when said contact carrier is in a predetermined position, said photoelectric sensor producing an electric output signal in response to a predetermined one of presence or absence of a reflected signal.

2. The auxiliary switch for an electromagnetic contactor defined in claim 1 wherein said reflective photoelectric sensor means is directed for receiving a reflected signal when said contact carrier is in said first position.

3. The auxiliary switch for an electromagnetic contactor defined in claim 1 wherein said reflective photoelectric sensor means is directed for receiving a reflected signal when said contact carrier is in said second position.

4. The auxiliary switch for an electromagnetic contactor defined in claim 1 wherein said reflective photoelectric sensor means is directed for receiving a reflected signal when said contact carrier is in a position intermediate said first position and said second position.

5. The auxiliary switch for an electromagnetic contactor defined in claim 1 wherein said signal emitted from said photoelectric sensor signal source is an infrared light beam, and said contactor and said auxiliary switch each comprise enclosures transmissive of infrared wavelength frequencies.

6. The auxiliary switch for an electromagnetic contactor defined in claim 1 wherein said contactor comprises an enclosure having a window adjacent said contact carrier and said photoelectric sensor means is directed at said window.

7. The auxiliary switch for an electromagnetic contactor defined in claim 6 wherein said contact carrier comprises a projection disposed in said window, said projection being a target for said signal emitted from said signal source of said photoelectric sensor.

8. The auxiliary switch for an electromagnetic contactor defined in claim 7 wherein said auxiliary switch comprises an enclosure transparent to a wavelength emitted from said sensor.

9. An auxiliary switch for an electromagnetic contactor wherein said contactor comprises:

a housing having a side wall and a window in said side wall;

an electromagnet in said housing, said electromagnet comprising a fixed core and a movable armature;

a target disposed internally of said housing, said target being operably connected to said armature and positioned in said window; and means biasing said armature to a first position spaced from said core whereat said target is at a first position in said window, operation of said electromagnet effecting movement of said armature to a second position whereat said target is at a second position in said window; and said auxiliary switch comprises:

a case attached to said side wall over said window; and photoelectric sensor means mounted to said case, said sensor emitting a light beam toward said window and receiving said light beam reflected from said target, said sensor generating an electrical output signal in response to a predetermined one of presence of said reflected light beam or absence of said reflected light beam for indicating a position of said armature.

10. The auxiliary switch defined in claim 9 wherein said photoelectric sensor means is positioned for reflecting said light beam from said target in said first position of said target for indicating said armature is in said first position of said armature.

11. The auxiliary switch defined in claim 9 wherein said photoelectric sensor means is positioned for reflecting said light beam from said target in said second position of said target for indicating said armature is in said second position of said armature.

12. The auxiliary switch defined in claim 9 wherein said photoelectric sensor means is positioned for reflecting said light beam from said target in a position of said target intermediate said first and second positions of said target for indicating said armature is in transition between said first and second positions of said armature.

13. The auxiliary switch defined in claim 9 wherein said photoelectric sensor means comprises a pair of said photoelectric sensor means, one of said pair positioned for reflecting a respective said light beam from said target in said first position of said target for indicating said armature is in said first position of said armature, and another of said pair positioned for reflecting a respective said light beam from said target in said second position of said target for indicating said armature in is said second position of said armature.

14. The auxiliary switch defined in claim 9 wherein said case encloses said photoelectric sensor means for providing a closed internal environment for said sensor.

15. The auxiliary switch defined in claim 9 wherein said case comprises a reduced wall thickness in juxtapostion to said window.

16. The auxiliary switch defined in claim 15 wherein said photoelectric sensor means comprises an infrared spectrum light beam.

17. The auxiliary switch defined in claim 9 wherein said case is transparent adjacent said window.

18. The auxiliary switch defined in claim 17 wherein said photoelectric sensor means comprises a visible spectrum light beam.

19. The auxiliary switch defined in claim 9 wherein said housing and said case comprises complimentary attachment means cooperable for snap-fit attaching said auxiliary switch to said contactor side wall.

20. An electromagnetic contactor and side mounted auxiliary switch wherein said contactor comprises:

a housing having a side wall;

an electromagnet in said housing, said electromagnet comprising a fixed core and a movable armature;

a target disposed in close proximity to said side wall and being operably connected to said armature; and means biasing said armature to a first position spaced from said core, said target being in a corresponding first position relative to said side wall, said electromagnet effecting movement of said armature to a second position whereat said target is at a corresponding second position relative to said side wall; and said auxiliary switch comprises:

a case attached to said side wall; and photoelectric sensor means mounted to said case, said sensor emitting a light beam through said case and said side wall and receiving said light beam reflected through said case and said side wall from said target when said target is in a predetermined one of said first and second positions, said sensor changing state of an electric output signal thereof in response to receipt of said reflected light.

* * * * *